US010047712B2

(12) United States Patent
Di Domizio et al.

(10) Patent No.: US 10,047,712 B2
(45) Date of Patent: Aug. 14, 2018

(54) FLUID INJECTION ASSEMBLY FOR A COMBUSTION ENGINE

(71) Applicant: Continental Automotive GmbH, Hannover (DE)

(72) Inventors: Gisella Di Domizio, San Giuliano Terme (IT); Daniel Marc, Leghorn (IT); Giandomencio Serra, Ghezzano-S. Giuliano Terme (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 14/909,301

(22) PCT Filed: Jul. 14, 2014

(86) PCT No.: PCT/EP2014/065014
§ 371 (c)(1),
(2) Date: Feb. 1, 2016

(87) PCT Pub. No.: WO2015/014595
PCT Pub. Date: Feb. 5, 2015

(65) Prior Publication Data

US 2016/0177903 A1 Jun. 23, 2016

(30) Foreign Application Priority Data

Jul. 31, 2013 (EP) ..... 13178699

(51) Int. Cl.
*F02M 61/14* (2006.01)

(52) U.S. Cl.
CPC ..... *F02M 61/14* (2013.01); *F02M 2200/856* (2013.01)

(58) Field of Classification Search
CPC ..... F02M 61/14; F02M 2200/856
(Continued)

(56) References Cited

U.S. PATENT DOCUMENTS 597,095 A 1/1898 Barrett ..... 215/26
5,038,738 A * 8/1991 Hafner ..... F02M 55/004 123/456

(Continued)

FOREIGN PATENT DOCUMENTS

DE 102005020380 A1 11/2006
EP 1892408 A1 2/2008

(Continued)

OTHER PUBLICATIONS

European Search Report, Application No. 13178699.8, 5 pages, dated Nov. 26, 2013.

(Continued)

*Primary Examiner* — Joseph Dallo
*Assistant Examiner* — Yi-Kai Wang
(74) *Attorney, Agent, or Firm* — Slayden Grubert Beard PLLC

(57) ABSTRACT

A fluid injection assembly for a combustion engine may comprise a spring clip arranged between an injector body and an injector cup. The spring clip may include a ground plate and at least one spring element fixedly coupled with the ground plate. The spring element has a contact region with the injector cup and the ground plate has a contact region with the injector body, so that a spring force is exerted by the spring clip on the injector body. The injector body and the injector cup are coupled together by two holding elements, each of the holding elements extending in the direction of the longitudinal axis and engaging behind a fixation element.

12 Claims, 6 Drawing Sheets

(58) Field of Classification Search
USPC ..... 123/470
See application file for complete search history.

(56) References Cited

U.S. PATENT DOCUMENTS

| | | | | |
|---|---|---|---|---|
| 5,724,946 | A | 3/1998 | Franchitto | 123/470 |
| 5,803,052 | A * | 9/1998 | Lorraine | F02M 61/145 123/456 |
| 5,970,953 | A * | 10/1999 | Lorraine | F02M 61/14 123/456 |
| 6,276,339 | B1 | 8/2001 | Shebert, Jr. et al. | 123/470 |
| 6,382,187 | B1 * | 5/2002 | Scollard | F02M 55/004 123/468 |
| 7,063,075 | B2 | 6/2006 | Berger et al. | 123/470 |
| 7,765,984 | B2 * | 8/2010 | Fuerst | F02M 55/025 123/456 |
| 7,802,559 | B2 | 9/2010 | Fürst et al. | 123/470 |
| 7,861,692 | B2 | 1/2011 | Biasci et al. | 123/470 |
| 7,938,455 | B2 * | 5/2011 | Rapp | F02M 55/002 285/305 |
| 8,701,632 | B2 * | 4/2014 | Solferino | F02M 61/14 123/470 |
| 2004/0237939 | A1 | 12/2004 | Kondo et al. | 123/470 |
| 2006/0137659 | A1 * | 6/2006 | Zdroik | F02M 55/005 123/470 |
| 2009/0235899 | A1 * | 9/2009 | Biasci | F02M 55/005 123/470 |
| 2011/0232609 | A1 | 9/2011 | Roseborsky et al. | 123/470 |

FOREIGN PATENT DOCUMENTS

| | | | |
|---|---|---|---|
| EP | 2221469 | B1 | 10/2011 |
| EP | 2058509 | B1 | 7/2012 |
| EP | 2492489 | A1 | 8/2012 |
| WO | 2011/144411 | A1 | 11/2011 |
| WO | 2015/014595 | A1 | 2/2015 |

OTHER PUBLICATIONS

International Search Report and Written Opinion, Application No. PCT/EP2014/065014, 10 pages, dated Oct. 10, 2014.
Chinese Office Action, Application No. 201480043151.3, 15 pages, dated Sep. 14, 2017.
Korean Office Action, Application No. 2017057977087, 12 pages, dated Aug. 21, 2017.

* cited by examiner

FLUID INJECTION ASSEMBLY FOR A COMBUSTION ENGINE

CROSS-REFERENCE TO RELATED APPLICATIONS

This application is a U.S. National Stage Application of International Application No. PCT/EP2014/065014 filed Jul. 14, 2014, which designates the United States of America, and claims priority to EP Application No. 13178699.8 filed Jul. 31, 2013, the contents of which are hereby incorporated by reference in their entirety.

TECHNICAL FIELD

The present disclosure generally relates to an assembly method and associated devices. More specifically, the present disclosure relates to a fluid injection assembly for a combustion engine.

RELATED APPLICATION

This patent application claims the priority of European patent application No. 13178699.8, the disclosure content of which is hereby incorporated by reference.

BACKGROUND

Fluid injection assemblies are in wide spread use, in particular for internal combustion engines where they may be arranged in order to dose fluid into an intake manifold of an internal combustion engine or directly into a combustion chamber of a cylinder of the internal combustion engine.

The correct orientation of such a high pressure fuel injection assembly in reference to the combustion chamber may provide improved performance and/or reliability.

U.S. Pat. No. 5,970,953 discloses a spring clip which includes a first portion including a bridge connecting spaced elongate fingers adapted to straddle a body portion of the fuel injector and be receivable in a receiving portion of a fuel rail cup. A second portion of a generally planar shape having spaced legs engages slots in the injector body. The second portion includes a wall portion extending generally perpendicular to the spaced legs and connects with the bridging portion. When the injector is mounted in the fuel rail cup, the legs are received in slots in the injector body and the elongate finger segments are compressed between the fuel rail cup and the injector body. The fuel injector is clamped between the legs and the fingers with a force toward the head of the engine by the compressive load of the finger segments. The clip is yieldable to avoid overloading the injector during installation in the engine.

SUMMARY

The present disclosure provides a fluid injection assembly for a combustion engine which can be handled particularly simple and reliable.

According to some embodiments of the disclosure, a fluid injection assembly for a combustion engine comprises a central longitudinal axis. The fluid injection assembly comprises an injector body and an injector cup which radially encloses an axial end of the injector body. The fluid injection assembly comprises a spring clip that is arranged between the injector cup and the injector body. The spring clip comprises a ground plate with a normal that is parallel to the longitudinal axis. The spring clip comprises at least one spring element fixedly coupled with the ground plate.

The spring element of the spring clip has a contact region with the injector cup and the ground plate has a contact region with the injector body. Thus, a spring force is exerted by the spring element on the injector body. The injector body and the injector cup are coupled together by two holding elements. Each of the holding elements extends in the direction of the longitudinal axis and engages behind a fixation element.

The injector body, the injector cup and the spring clip may be separate parts. In particular, they are separately manufactured parts.

In some embodiments, the two holding elements are a part of the injector body. In one development, the two holding elements are integrally formed as a part of the injector body. For example, the injector body has a plastic housing which extends circumferentially around a metal tube and the holding elements are comprised by the plastic housing. In another development of this embodiment, the injector body with the holding elements is non-destructively removable from the spring clip and the injector cup.

In some embodiments, the two holding elements are a part of the injector cup. In a development of this embodiment, the injector cup with the holding elements is non-destructively removable from the spring clip and the injector body.

Due to the two holding elements that extend from the injector body to the injector cup a rotary movement between injector cup and spring clip is prevented. The two holding elements realize an easy adjustment of the spring clip and the injector body with respect to the injector cup. The injector cup can be produced cost effective, for example the injector cup is simply deep drawn. The spring clip can be produced cost effective too since the shape of the spring clip is very easy to obtain. Furthermore, due to the presence of the two holding elements an inclination between the injector body and the injector cup during transportation is avoided. In addition, the fluid injection assembly comprises a small radial overall dimension due to the axial mounting. In case of service operation the injector cup and the injector body are easy to dismount. For example, when the fluid injection assembly is stacked to the cylinder head because of coking the fluid injection assembly can be dismounted by applying an axial force to the fuel rail without breaking any component and all the components can be used after the service operation.

According to some embodiments the spring clip comprises a bore through the ground plate. The ground plate completely surrounds the bore. The bore may extend completely through the ground plate in longitudinal direction. Thus, a movement of the spring clip in perpendicular to the longitudinal axis is blocked in all radial directions.

According to some embodiments the holding elements each comprise a projecting part that projects in a vertical direction to the longitudinal axis, i.e., in a radial direction. The projecting parts may face towards one another or face away from one another in a radial direction. For example, each of the holding elements has a bar which is elongated in longitudinal direction, the respective projecting part is positioned at one axial end of the bar and projects radially beyond the bar. By means of the projecting parts of the holding elements a movement of the injector cup with respect to the injector body in a direction of the longitudinal axis is limited. That the holding element extends in the direction of the longitudinal axis and engages behind the fixation element in this case means in particular that the projecting part laterally overlaps the fixation element on a first side of the fixation element and the bar extends from the first side of the fixation element to a second side, opposite of the first side in longitudinal direction, of the fixation element alongside or through the fixation element and preferably projects in longitudinal direction beyond the second side of the fixation element.

In some embodiments, the projecting parts laterally overlap the ground plate to limit axial displacement of the spring clip with respect to the injector body. In this way, the risk to lose the spring clip is particularly small.

According to some embodiments the holding elements are formed as a part of the injector cup. The projecting parts of the holding elements engage behind a separate fixation element to couple the injector cup with the injector body.

According to some embodiments, the fixation element is a separate part arranged between the injector cup and the respective projecting parts of the holding elements. A collar of the injector cup, the fixation element and the respective projecting part follow one another in this order in longitudinal direction, in particular so that they are operable to establish a form-fit connection between the collar and the fixation element and between the fixation element and the projecting parts to limit axial displacement of the injector body away from the injector cup.

In some embodiments, each of the holding elements is integrally formed as a part of the injector body. In one development, the injector cup comprises two recesses that correspond to the two holding elements such that a rotation of the injector cup with respect to the injector body is prevented. In another development, the fixation element is integrally formed as a projecting part—preferably a radially projecting collar—of the injector cup. In yet another development, the ground plate comprises two recesses that correspond to the two holding elements such that a rotation of the spring clip with respect to the injector body is prevented.

In some embodiments, the two holding elements are formed as a part of the injector cup. In one development, each holding element comprises a projecting part. The projecting parts preferably face towards each other, in particular they project in a radially inward direction from the bar of the respective holding element. In one embodiment, the injector body comprises two flat lateral faces. Preferably, each of the projecting parts of the holding elements are in contact with one of the flat lateral faces such that a rotation of the injector cup with respect to the injector body is prevented. With advantage, relative rotational displacement of the injector cup and the injector body may be blocked by direct mechanical interaction of the injector cup with the injector body.

In some embodiments, the fixation element is a separate part arranged between the injector body and the respective projecting parts of the holding elements. A collar of the injector cup, the fixation element and the respective projecting part follow one another in this order in longitudinal direction, in particular so that they are operable to establish a form-fit connection between the collar and the fixation element and between the fixation element and the projecting parts to limit axial displacement of the injector body away from the injector cup.

In some embodiments, the at least one spring element is a spring arm formed integrally with the ground plate, for example by bending.

According to some embodiments the fluid injection assembly comprises more than two holding elements and respective recesses or flat lateral faces respectively.

BRIEF DESCRIPTION OF THE DRAWINGS

Exemplary embodiments of the invention are explained in the following with the aid of schematic drawings. The same elements, elements of the same type and elements having the same effect may be provided with the same reference numerals in the figures.

DETAILED DESCRIPTION

Figure 1:
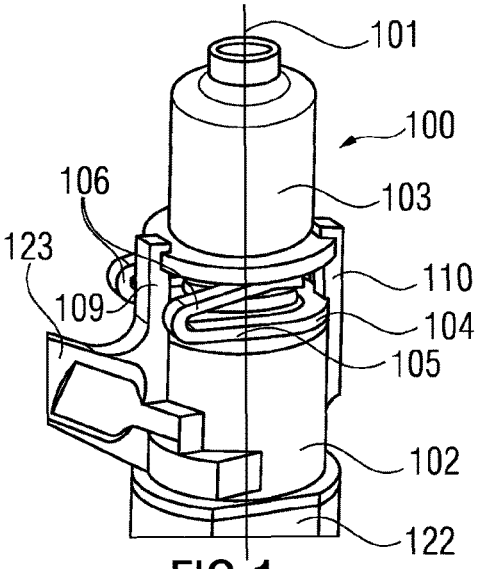
FIG. 1 schematically shows a fluid injection assembly according to embodiments of the present disclosure, FIG. 2 schematically shows an injector body in more detail according to embodiments of the present disclosure, FIG. 3 schematically shows a spring clip in more detail according to embodiments of the present disclosure, FIG. 4 schematically shows an injector cup in more detail according to embodiments of the present disclosure, FIG. 5 schematically shows a fluid injection assembly according to embodiments of the present disclosure, FIG. 6 schematically shows a fluid injection assembly according to embodiments of the present disclosure, FIG. 7 schematically shows a fluid injection assembly according to embodiments of the present disclosure, FIG. 8 schematically shows a fluid injection assembly according to embodiments of the present disclosure, FIG. 9 schematically shows an injector body in more detail according to embodiments of the present disclosure, FIG. 10 schematically shows a spring clip in more detail according to embodiments of the present disclosure, FIG. 11 schematically shows an injector cup in more detail according to embodiments of the present disclosure, FIG. 12 schematically shows a fixation element in more detail according to embodiments of the present disclosure, FIG. 13 schematically shows a fluid injection assembly according to embodiments of the present disclosure, FIG. 14 schematically shows a fluid injection assembly according to embodiments of the present disclosure, FIG. 15 schematically shows a fluid injection assembly according to embodiments of the present disclosure, FIG. 16 schematically shows an injector body in more detail according to embodiments of the present disclosure, FIG. 17 schematically shows an injector cup in more detail according to embodiments of the present disclosure, FIG. 18 schematically shows a fixation element in more detail according to embodiments of the present disclosure, FIG. 19 schematically shows a fluid injection assembly according to embodiments of the present disclosure, and FIG. 20 schematically shows a fluid injection assembly according to embodiments of the present disclosure.

FIG. 1 schematically shows a fluid injection assembly 100 according to one embodiment. The fluid injection assembly 100 is particularly suitable for dosing fuel to an internal combustion engine. The fluid injection assembly 100 comprises a central longitudinal axis 101. The fluid injection assembly 100 further comprises an injector body 102 that comprises an injector sleeve 122. The fluid injection assembly 100 further comprises an injector cup 103 that radially encloses an axial end of the injector body 102. The fluid injection assembly 100 further comprises a spring clip 104 that is arranged between the injector cup 103 and the injector body 102.

The injector sleeve 122 may be configured for hydraulically coupling a fluid inlet end of the injector body 102 to a fluid outlet end of the injector body 102. Expediently, the fluid inlet end is received in the in the injector cup 103 and the fluid outlet end is remote from the injector cup 103.

The injector body 102 comprises a connector 123 for connecting the fluid injection assembly 100 to an electrical power supply and/or an electronic control unit. The injector body 102 further comprises two holding elements 109 and 110.

The holding elements 109 and 110 each extend from the injector body 102 to the injector cup 103 to limit a movement of the injector cup 103 in direction of the longitudinal axis 101 away from the injector body 102.

The spring clip 104 comprises a ground plate 105 that is in contact with the injector body 102. The spring clip 104 further comprises two spring elements 106 that are in contact with the injector cup 103. The spring element 104 exerts a spring force in direction of the longitudinal axis 101 such that the injector body 102 and the injector cup 103 are pushed away from each other.

Figure 2:
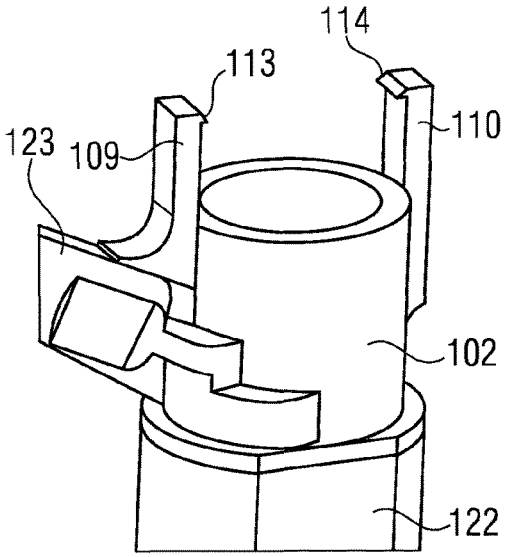

FIG. 2 schematically shows the injector body 102 in more detail. The two holding elements 109 and 110 are arranged at a distance from each other. For example, the two holding elements 109 and 110 are arranged face to face with each other.

The holding element 109 comprises a projecting part 113. The holding element 110 comprises a projecting part 114. Each of the holding elements 109, 110 is in the shape of a longitudinally elongated bar with the respective projecting part 113, 114 at one axial end of the respective bar. The projecting parts 113 and 114 are arranged at the side of the holding elements 109, 110 that is remote from the injector sleeve 122. The two projecting parts 113 and 114 are facing each other. The projecting part 113, 114 of each holding element 109, 110 projects beyond the bar of the holding element in radially inward direction. The holding elements 109 and 110 are flexible and elastic. Thus, the holding elements 109 and 110 can snap fit over a radially projecting collar 117 of the injector cup 104 (FIG. 4) for mounting the fluid injection assembly 100.

Figure 3:
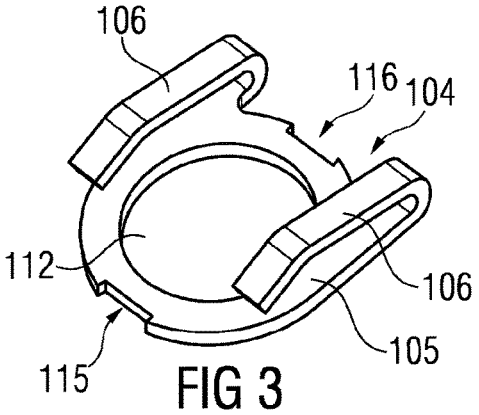

FIG. 3 shows the spring clip 104 in more detail. The ground plate 104 completely surrounds a bore 112. When ready for use the injector sleeve 122 extends through the bore 112 in axial direction 101. The ground plate 105 comprises two recesses 115 and 116. The position of the recesses 115 and 116 corresponds to the position of the holding elements 109 and 110. The position of the recesses 115 and 116 defines the relative orientation of the spring clip 104 with respect to the injector body 102. The holding elements 109 and 110 can be arranged in the recesses 115 and 116 and thus a rotation of the spring clip 104 with respect to the injector body 102 is prevented. The spring elements 106 each are spring arms that are formed integrally with the ground plate by vending. For example, the spring clip 104 is made of metal.

Figure 4:
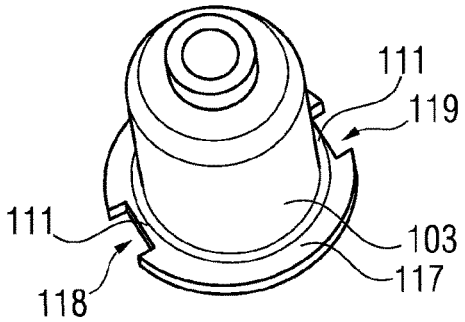

FIG. 4 schematically shows the injector cup 103 in more detail. The injector cup 103 comprises a radially outward projecting collar 117. The radially outward projecting collar 117 comprises a fixation element 111 and two recesses 118 and 119. For coupling the injector cup 103 and the injector body 102 the projecting parts 113 and 114 of the holding elements 109 and 110 engage behind the fixation elements 111 at the radially projecting collar 117. To define the relative orientation of the injector cup 103 with respect to the injector body 102 the holding element 109 and 110 can be arranged in the recesses 118 and 119. When the holding elements 109 and 110 are coupled in the recesses 118 and 119 a rotational movement of the injector cup 103 with respect to the injector body 102 is prevented.

Figure 5:
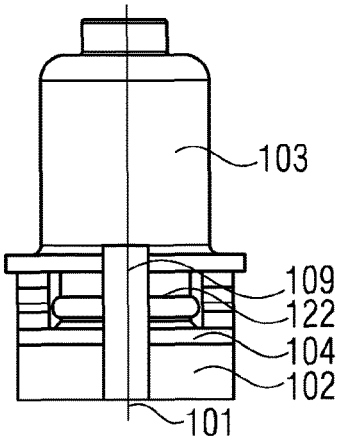

FIG. 5 schematically shows a side view of the coupling of the injector body 102 and the injector cup 103 by the holding element 109. The spring clip 104 is arranged between the injector cup 103 and the injector body 102 to allow a movement of the injector body 102 and the injector cup 103 with respect to each other in a direction of the longitudinal axis 101.

Figure 6:
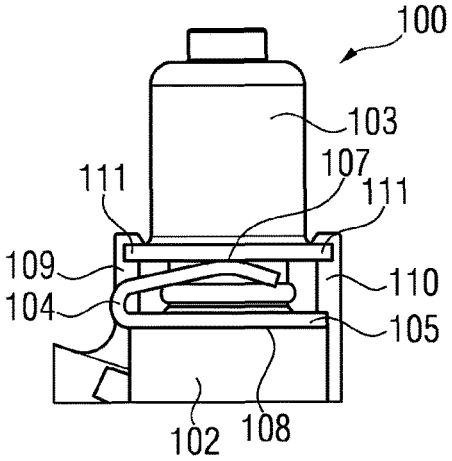

FIG. 6 schematically shows another side view of the fluid injection assembly 100. The ground plate 105 of the spring clip comprises a contact region 107 with the ground plate 105. The two spring elements 106 each comprise a contact region 108 with the injector cup 103. The projecting parts 113, 114 laterally overlap the fixation element 111 on a first side of the fixation element 111. The bars of the holding elements 109, 110 extend from the first side of the fixation element 111 to a second side of the fixation element 111—and in particular the collar 117—alongside the fixation element 111 and project in longitudinal direction beyond the second side to the ground plate 105 of the spring clip 104. The second side is opposite of the first side in longitudinal direction 101.

Figure 7:
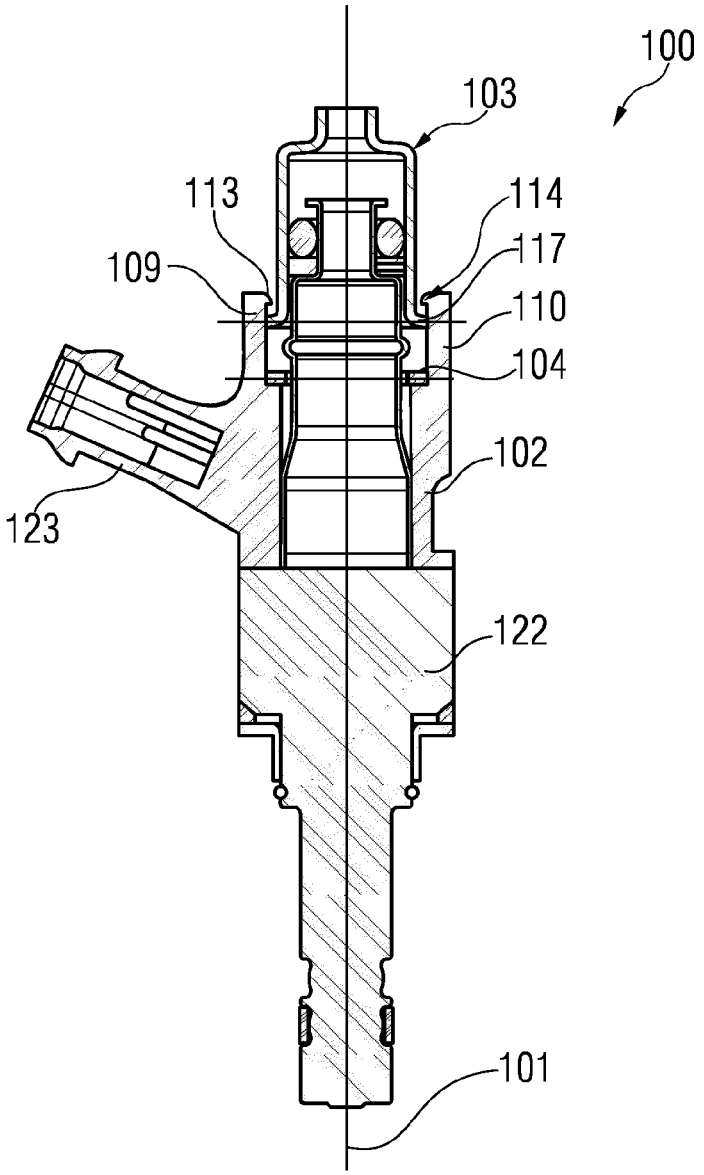

FIG. 7 schematically shows a cross-sectional view of the fluid injection assembly 100 according to embodiments. The interior of the injector sleeve 122 is omitted in FIG. 7 for the sake of simplicity.

As shown in FIG. 7 the projecting parts 113 and 114 and the radially projecting collar 117 of the injector cup 103 can have a clearance from each other during operation to allow the relative movement in direction of the longitudinal axis 101. The injector cup 103 with the recesses 118 and 119 at the radially projecting collar 117 is coupled to the injector body 102, in particular to an overmold over the injector sleeve 122. The injector body 102—preferably the overmold—comprises the holding elements 109 and 110 with the projecting parts 113 and 114. The number of the recesses 118 and 119 and the number of the holding elements 109 and 110 are identical. The spring clip 104 comprises a number of recesses 115 and 116 identical to the number of the holding elements 109 and 110.

The recesses 115, 116 of the ground plate 105 of the spring clip 104 are positioned and dimensioned such that the projecting parts 113, 114 laterally overlap the ground plate 105. Thus, the spring clip 104 snaps into the two holding elements 109 and 110 when it is axially inserted onto the injector sleeve 122. After the insertion it is not possible to loosen or to rotate the spring clip 104 with respect to the axis 101.

When the injector sleeve 122 with the injector body 102 and the spring clip 104 is inserted into the injector cup 103, the holding elements 109 and 110 snap fit over the fixation element 111 at the radially projecting collar 117. The recesses 118 and 119 and secure the connection between the injector body 102 and the injector cup 103. The indexing function between the components is guaranteed by the contrast between the holding elements 109 and 110 and the recesses 118 and 119. In this way the rotational movements of any component with respect to the fuel rail and therefore with respect to the combustion chamber is avoided.

Figure 8:
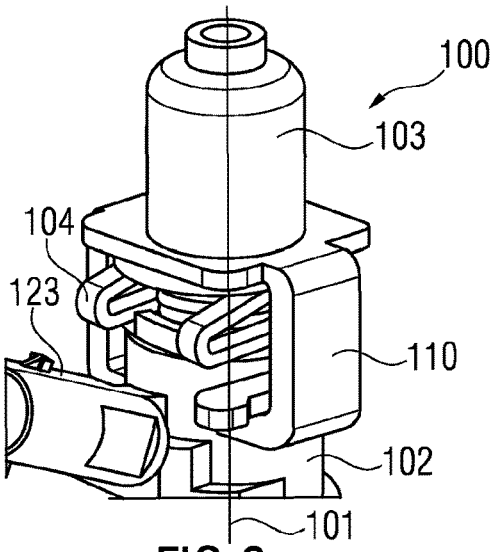

FIG. 8 schematically shows the fluid injection assembly 100 according to a further embodiment. In contrast to the embodiment described with respect to FIGS. 1 to 7, the holding elements 109 and 110 are parts of the injector cup 103. For example, the holding elements 109 and 110 are integrally formed with the injector cup 103, for example in one piece with a base body of the injector cup 103. Alternatively, they can be fixed to the base body, for example by brazing or welding.

As a further alternative, the holding elements 109, 110 may protrude in longitudinal direction from a ring in which a base body of the injector cup 103 is received. Longitudinal displacement of the ring with respect to the base body may be limited by mechanical interaction of the ring with a radially projecting collar of the base body. The collar is in particular positioned at a downstream end of the base body and the ring may abut the collar at an upstream side thereof.

Figure 9:
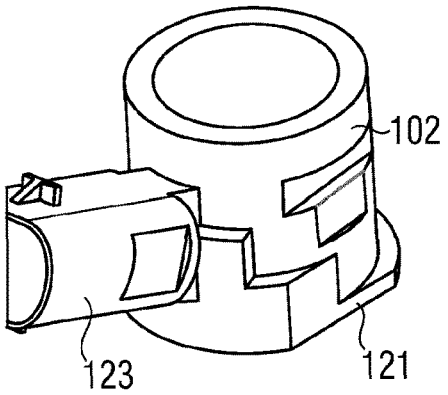

FIG. 9 shows the injector body 102 in more detail. The injector body 102 comprises two flat lateral faces 120 (FIG. 13) and 121. The flat lateral faces 120 and 121 are configured to define the relative orientation of the injector cup 103 with respect to the injector body 102.

Figure 10:
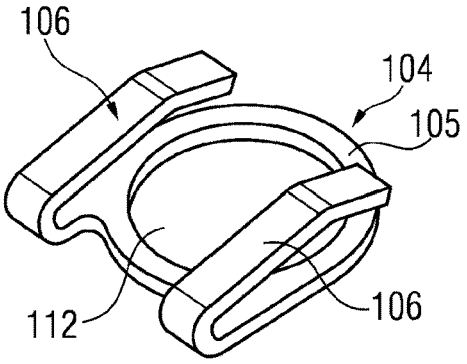

FIG. 10 schematically shows the spring clip 104 in more details. In contrast to the spring clip 104 as described with respect to FIG. 3 the spring clip 104 of FIG. 10 does not comprise the two recesses 115 and 116.

Figure 11:
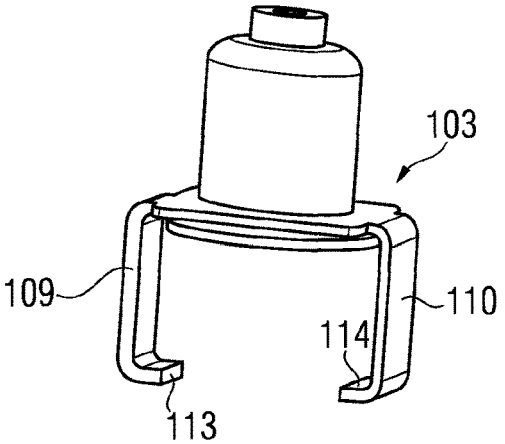

FIG. 11 schematically shows the injector cup 103 in more detail. The injector cup 103 comprises the two holding elements 109 and 110. The holding elements 109, 110 project beyond the base body of the injector cup 103—in which the injector body 102 is inserted—in downstream direction, i.e. in longitudinal direction towards the fluid outlet end of the injector sleeve 122. The projecting parts 113 and 114 are facing each other. The projecting parts 113 and 114 are configured to interact with the flat lateral faces 120 and 121 for preventing a rotational movement of the injector cup 103 and the injector body 102 with respect to each other.

Figure 12:
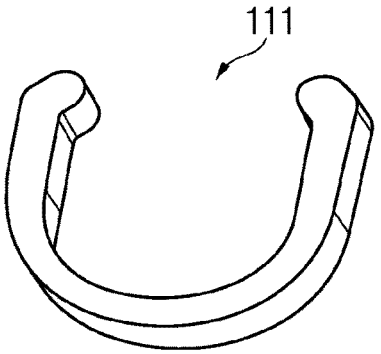

FIG. 12 schematically shows the fixation element 111 in more detail. In the present embodiment, the fixation element 111 is a separate part that can be snap fitted in a notch 124 (FIG. 14) of the injector body 102 to limit an axial movement of the injector cup 103 with respect to the injector body 102 by means of mechanical interaction with the injector body 102 and with the projecting parts 113, 114.

Figure 13:
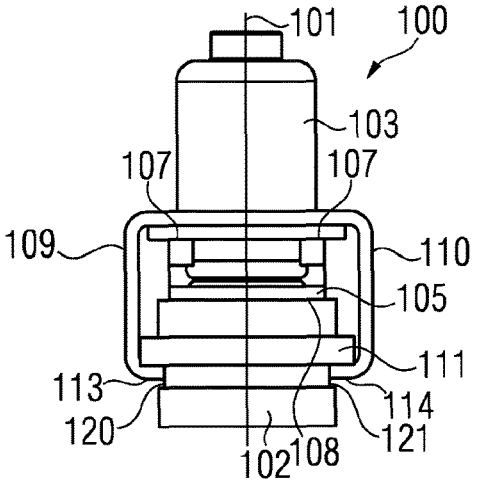

FIG. 13 schematically shows a side view of the fluid injection assembly 100. The projecting parts 113 and 114 engage behind the fixation element 111 and are coupled to the flat lateral faces 120 and 121 respectively. The collar of the base body of the injector cup 113, the fixation element 111 and the projecting parts 113, 114 follow one another in this order in downstream direction along the longitudinal axis 101. Thus, a movement of the injector cup 103 away from the injector body 102 is limited. In this way, the risk to lose parts of the fluid injection assembly before it is fixed to the cylinder head is particularly small in this and the other embodiments of the fluid injection assembly.

Figure 14:
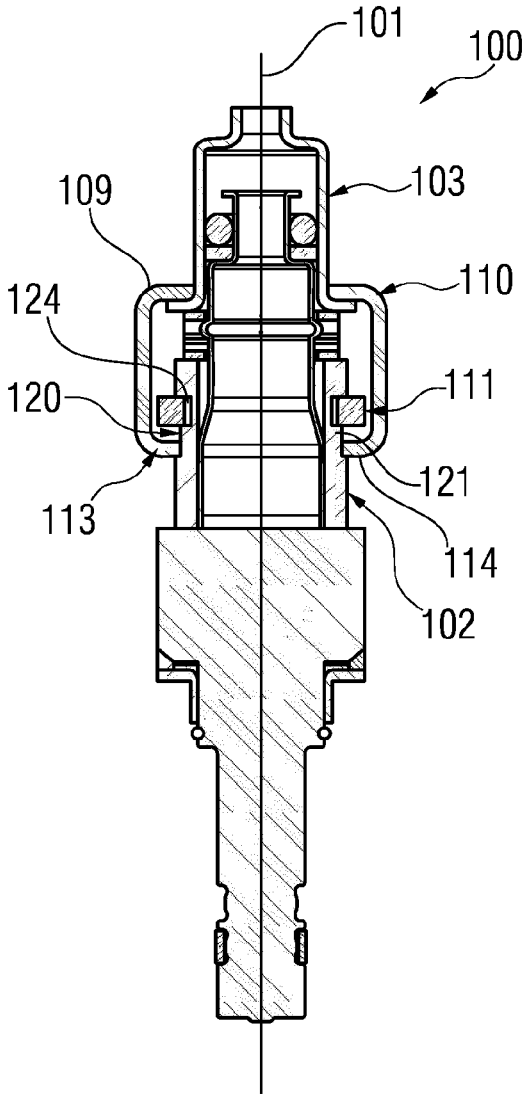

FIG. 14 schematically shows a cross-sectional view of the fluid injection assembly 100. The fluid injection assembly 100 according to the FIGS. 8 to 14 comprises the injector cup 103. The holding elements 109 and 110 that for example are brazed or welded on the radially projecting collar 117 of the injector cup 103. The injector cup 103 for example is obtained by stamping or bending of sheet metal. The indexing of the injector body 102 with respect to the injector cup 103 is obtained by the contrast between the flat lateral faces 120 and 121 and the projecting parts 113 and 114. The projecting parts 113 and 114 and the fixation element 111 can have a clearance from each other during operation to allow the relative movement of the injector cup 103 and the injector body 104 with respect to each other in direction of the longitudinal axis 101.

For manufacturing the fluid injection assembly, the spring clip 104 is assembled over the injector sleeve 122. The injector sleeve 122 with the injector body 102 and the spring clip 104 are axially inserted into the injector cup 103. The injector cup 103 is arranged at the fuel rail. Once the injector sleeve 122 with the injector body 102 is in position the fixation element 111 is radially inserted to the notch 124 to prevent any detaching of the injector sleeve 122 and the injector body 102 from the rail. For example, the fixation element 111 is made of plastic or steel.

For disassembly of the fluid injection assembly, e.g. for service operations, two options are possible, for example. The fixation element 111 can be broken by applying a vertical force. Alternatively, the shape of the fixation element 111 can be provided in combination with the design of the holding elements 109 and 110 to allow their opening and dismounting of the fluid injection assembly when sufficient axial force is applied without breaking any component.

Figure 15:
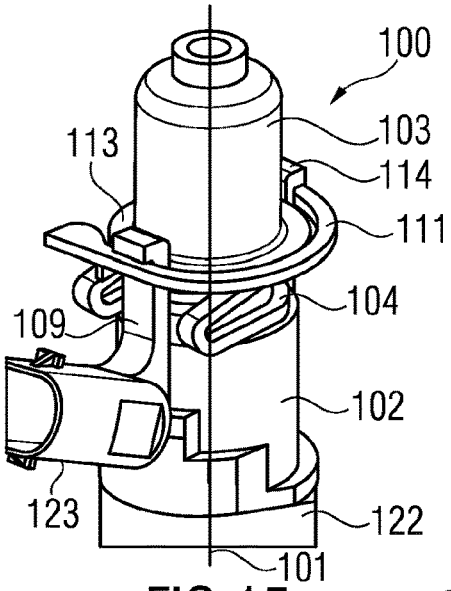

FIG. 15 schematically shows the fluid injection assembly 100 according to a further embodiment. In contrast to the embodiments described with respect to FIGS. 1 to 14, the projecting parts 113 and 114 are directed outwards and facing away from each other. The movement of the injector body 102 away from the injector cup 103 is prevented by the separate fixation element 111 that is arranged axially between the projecting parts 113 and 114 and the radially projecting collar 117 of the injector cup 103.

Figure 16:
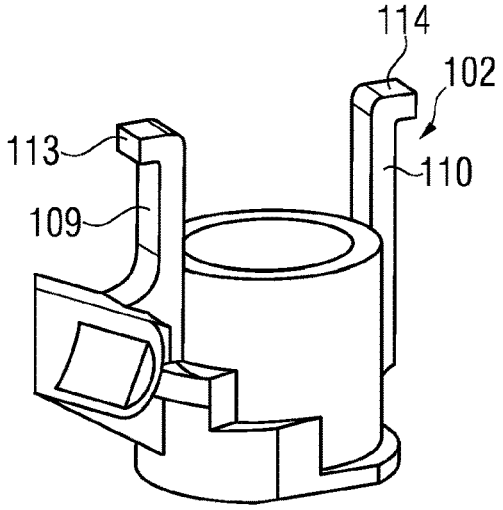

FIG. 16 schematically shows the injector body 102 in more detail. The holding elements 109 and 110 comprise the projecting parts 113 and 114 that are facing away from each other. According to embodiments the holding elements 109 and 110 are rigid, i.e. not flexible or elastic.

Figure 17:
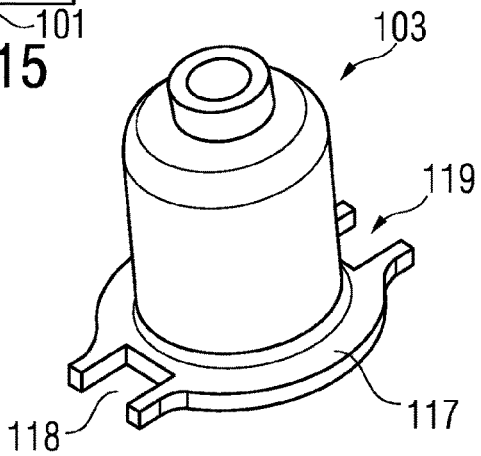

FIG. 17 schematically shows the injector cup 103 in more detail. The injector cup 103 comprises the two recesses 118 and 119 at the radially projecting collar 117. The recesses 118 and 119 are designed to interact with the holding elements 109 and 110 to prevent a relative rotational movement of the injector body 102 with respect to the injector cup 103.

Figure 18:
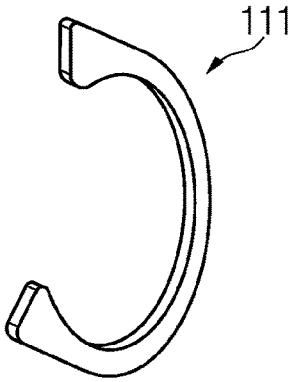

FIG. 18 schematically shows the fixation element 111 in more detail. The fixation element 111 can be snap fitted over the holding elements 109 and 110 to limit the axial movement of the injector body 102 and the injector cup 103 with respect to each other.

Figure 19:
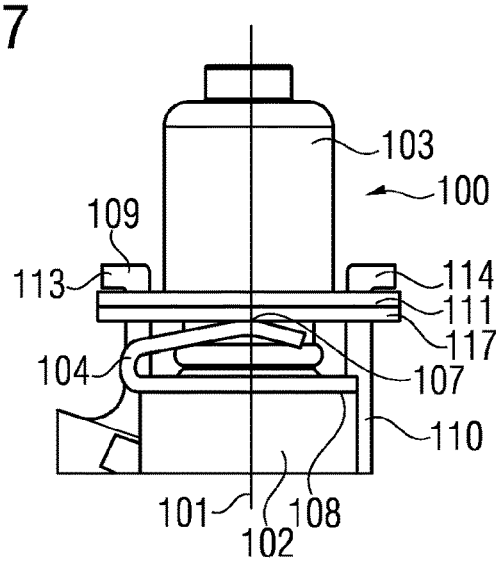

FIG. 19 schematically shows a side view of the fluid injection assembly 100. The holding elements 109 and 110 extend through the recesses 118 and 119 of the injector cup 103. The projecting parts 113 and 114 engage behind the fixation element 111. However, the projecting parts 113, 114 do not laterally overlap the injector cup 103. Rather, they laterally overlap the fixation element 111 which in turn laterally overlaps the collar 117 of the injector cup 103. The projecting parts 113 and 114, the fixation element 111 and the collar 117 follow one another in this order in longitudinal direction and are configured to establish a form-fit connection between the projecting parts 113, 114 and the fixation element 111 and between the fixation element 111 and the collar 117 so that axial displacement of the injector body 102 with respect to the injector cup 103 is blocked.

Figure 20:
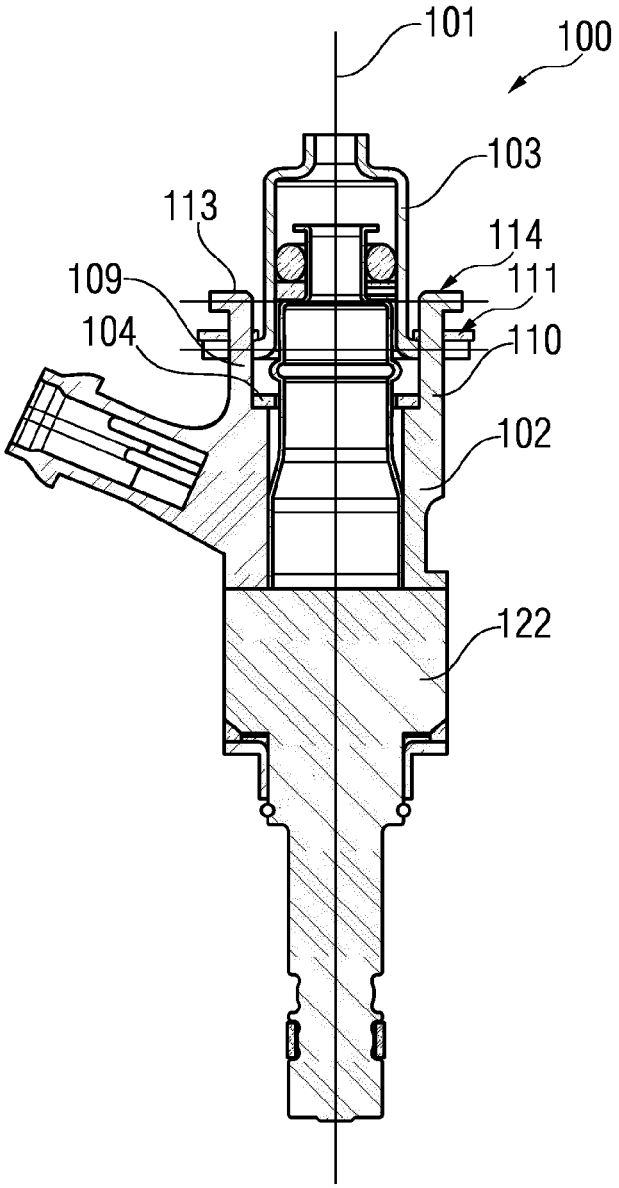

FIG. 20 schematically shows a cross-sectional view of the fluid injection assembly 100 according to the embodiments of FIGS. 15 to 19. The spring clip 104 may be designed as shown in FIG. 10. For assembling, the spring clip 104 is axially inserted over the injector sleeve 122. According to one embodiment, the spring clip 104 has no indexing function and may work with any orientation. Next, the injector sleeve 122 and the injector body 102 as well as the spring clip 104 are pressed inside the injector cup 103. The two holding elements 109 and 110 match with the recesses 118 and 119 on the radially projecting collar 117. The indexing or antirotation is obtained through the two holding elements 109 and 110 and the corresponding recesses 118 and 119. Next, the fixation element 111 that can either be made of steel or plastic is inserted between the radially projecting collar 117 of the injector cup 103 and the projecting parts 113 and 114 of the holding elements 109 and 110. Thus, the movement of the injector cup 103 away from the injector body 102 is limited. The projecting parts 113 and 114 and the fixation element 111 can have a clearance from each other during operation to allow the relative movement of the injector cup 103 and the injector body 104 with respect to each other in direction of the longitudinal axis 101. Furthermore, an inclination of the injector body 102 with respect to the injector cup 103 can be avoided due to the two opposite holding elements 109 and 110 having a short distance from the injector cup 103.

According to one embodiment the fixation element 111 is dimensioned to be the weakest component of the assembly. Thus, for disassembling the fluid injection assembly during service operation the fixation element 111 can be broken and other, much more expensive components are not damaged and can be reused.

The invention is not limited to specific embodiments by the description on the basis of said exemplary embodiments but comprises any combination of elements of different embodiments. Moreover, the invention comprises any combination of claims and any combination of features disclosed by the claims.

What is claimed is:

1. A fluid injection assembly for a combustion engine, the assembly comprising:

a central longitudinal axis, an injector body, an injector cup radially enclosing an axial end of the injector body, a spring clip arranged between the injector body and the injector cup, the spring clip comprising:

a ground plate with a normal parallel to the longitudinal axis, at least one spring element fixedly coupled with the ground plate, wherein the at least one spring element has a contact region with the injector cup and the ground plate has a contact region with the injector body, so that a spring force exerted by the spring clip on the injector body urges the injector body away from the injector cup, and two holding elements, each of the holding elements extending from the injector body in the direction of the longitudinal axis and engaging with a snap-fit into a respective recess defined on a collar of the injector cup, wherein the two holding elements, when snapped into the respective recesses, restrict relative rotational movement between the injector body and the injector cup.

2. The fluid injection assembly according to claim 1, wherein the two holding elements each comprise a projecting part, the projecting parts each projecting in a radial direction from the central longitudinal axis.

3. The fluid injection assembly according to claim 2, wherein the projecting parts laterally overlap the ground plate to limit axial displacement of the spring clip away from the injector body.

4. The fluid injection assembly according to claim 2, wherein:

each holding element comprises a bar elongated in longitudinal direction, the projecting part is positioned at one axial end of the bar and projects radially beyond the bar, the projecting part laterally overlaps the fixation element on a first side of the fixation element, the bar extends from the first side of the fixation element to a second side of the fixation element opposite of the first side in longitudinal direction, alongside or through the fixation element, and projects in longitudinal direction beyond the second side of the fixation element.

5. The fluid injection assembly according to claim 2, wherein the fixation element is a separate part arranged between the injector cup and the respective projecting parts of the holding elements.

6. The fluid injection assembly according to claim 1, wherein:

each of the holding elements is integrally formed as a part of the injector body, and the injector cup comprises two recesses that correspond to the two holding elements such that a rotation of the injector cup with respect to the injector body is prevented.

7. The fluid injection assembly according claim 1, wherein:

each of the holding elements is integrally formed as a part of the injector body, and the fixation element is integrally formed as a radially projecting collar of the injector cup.

8. The fluid injection assembly according to claim 1, wherein:

each of the holding elements is integrally formed as a part of the injector body, and the ground plate comprises two recesses that correspond to the two holding elements such that a rotation of the spring clip with respect to the injector body is prevented.

9. The fluid injection assembly according to claim 1, further comprising:

two additional holding elements projecting from the injector cup and each faces towards the other, the injector body comprises two flat lateral faces, and each of the projecting parts of the holding elements are in contact with one of the flat lateral faces such that a rotation of the injector cup with respect to the injector body is prevented.

10. The fluid injection assembly according to claim 9, wherein the fixation element is a separate part arranged between the injector body and the respective projecting parts of the holding elements.

11. The fluid injection assembly according to claim 1, wherein the at least one spring element is a spring arm formed integrally with the ground plate.

12. An internal combustion engine comprising:

a combustion chamber;

an injector body arranged to inject fuel into the combustion chamber, the injector body having a central longitudinal axis;

an injector cup radially enclosing an axial end of the injector body, a spring clip arranged between the injector body and the injector cup, the spring clip comprising:

a ground plate with a normal parallel to the longitudinal axis, at least one spring element fixedly coupled with the ground plate, wherein the at least one spring element has a contact region with the injector cup;

the ground plate has a contact region with the injector body, so that a spring force exerted by the spring clip on the injector body urges the injector body away from the injector cup, and two holding elements, each of the holding elements extending from the injector body in the direction of the longitudinal axis and engaging with a snap-fit into a respective recess defined on a collar of the injector cup, wherein the two holding elements, once snapped into the respective recesses, restrict relative rotational movement between the injector body and the injector cup.

* * * * *